US005482237A

United States Patent [19]

Wang

[11] Patent Number: 5,482,237

[45] Date of Patent: Jan. 9, 1996

[54] MOUNTING BLOCK

[76] Inventor: Tin-Chou Wang, No. 54, Lane 120, Sec. 6, Minchuan E. Rd., Taipei, Taiwan

[21] Appl. No.: 237,382

[22] Filed: May 3, 1994

[51] Int. Cl.[6] ..... A47B 96/06

[52] U.S. Cl. ..... 248/219.3; 248/230.7; 248/125.1; 403/104; 403/397

[58] Field of Search ..... 248/125, 219.3, 248/230, 307, 514; 211/181, 182, 207; 403/104, 353, 397, 265

[56] References Cited

U.S. PATENT DOCUMENTS

| | | | |
|---|---|---|---|
| 3,797,790 | 3/1974 | Iseki | 248/221 |
| 3,945,596 | 3/1976 | Marraccini | 248/311 |
| 4,712,756 | 12/1987 | Kester et al. | 248/165 |
| 4,717,103 | 1/1988 | Kester et al. | 248/231.3 |
| 4,754,841 | 7/1988 | Koffski | 182/92 |
| 4,977,850 | 12/1990 | King | 116/109 |
| 5,014,861 | 5/1991 | Städtler | 211/182 |
| 5,152,481 | 10/1992 | Cote et al. | 244/153 |

*Primary Examiner*—Leslie A. Braun

*Assistant Examiner*—Gwendolyn Wrenn

*Attorney, Agent, or Firm*—Morton J. Rosenberg; David I. Klein

[57] ABSTRACT

A block includes first and second through holes extending from an upper side thereof through a lower side thereof. A necking passage section is defined between and thus communicates with the first and second through holes. A lower end of the first through hole coincides with the lower end of the second through hole. The first through hole has a central axis which is at an angle to that of the second through hole. The first through hole has a diameter the same as that of a rod to which the block is mounted. The upper end of the second through hole has a diameter greater than that of the rod and tapers to the lower end of the second through hole which coincides with the lower end of the first through hole. The necking passage section is resilient to allow the rod to be forcibly moved between the first and second through holes. An antislip member is provided to an inner periphery of the first through hole. The rod is retained in position when it is received in the first through hole. When the rod is received in the second through hole, the block is slidable along the rod.

6 Claims, 4 Drawing Sheets

MOUNTING BLOCK

BACKGROUND OF THE INVENTION

1. Field of the Invention

The present invention relates to a mounting block and, more particularly, to a mounting block which can be adjustably mounted to a rod of a clothes rack, flower pot display shelf, black board shelf, or the like.

2. Description of Related Art

Mounting blocks used on clothes racks, flower pot display shelves, black board shelves or the like are generally adjustably retained in position by means of bolts or similar structures. However, when adjustment is required, it is troublesome for the user to unscrew and rescrew the bolts. The present invention is intended to provide an improved mounting block to solve this problem.

SUMMARY OF THE INVENTION

The present invention provides a block which is adapted to be adjustably mounted to a rod of a clothes rack, flower pot display shelf, black board shelf, or the like. The block includes upper and lower sides. A first through hole extends from the upper side through the lower side and has upper and lower ends. A second through hole also extends from the upper side through the lower side and has upper and lower ends. The first and second through holes communicate with each other via a necking passage section formed therebetween. The lower end of the first through hole coincides with the lower end of the second through hole. The first through hole has a central axis which is at an angle to that of the second through hole.

The first through hole has a diameter the same as that of the rod. The upper end of the second through hole has a diameter greater than that of the rod and tapers to the lower end of the second through hole which coincides with the lower end of the first through hole. The necking section is resilient to allow the rod to be forcibly moved between the first and second through holes. An antislip means is provided to an inner periphery of the first through hole.

By such an arrangement, when the rod is received in the first through hole, the rod is retained in position, and when the rod is received in the second through hole, the block is slidable along the rod.

In accordance with one aspect of the invention, the first through hole extends in a vertical direction.

In accordance with another aspect of the invention, the first and second through holes are perpendicular to each other.

The antislip means may be either an antislip piece or a layer of antislip glue for retaining the rod in position.

The first and second through holes may have a sectional configuration the same as that of the rod to which the block is mounted.

Other objects, advantages, and novel features of the invention will become more apparent from the following detailed description when taken in conjunction with the accompanying drawings.

DESCRIPTION OF THE PREFERRED EMBODIMENTS

Figure 1:
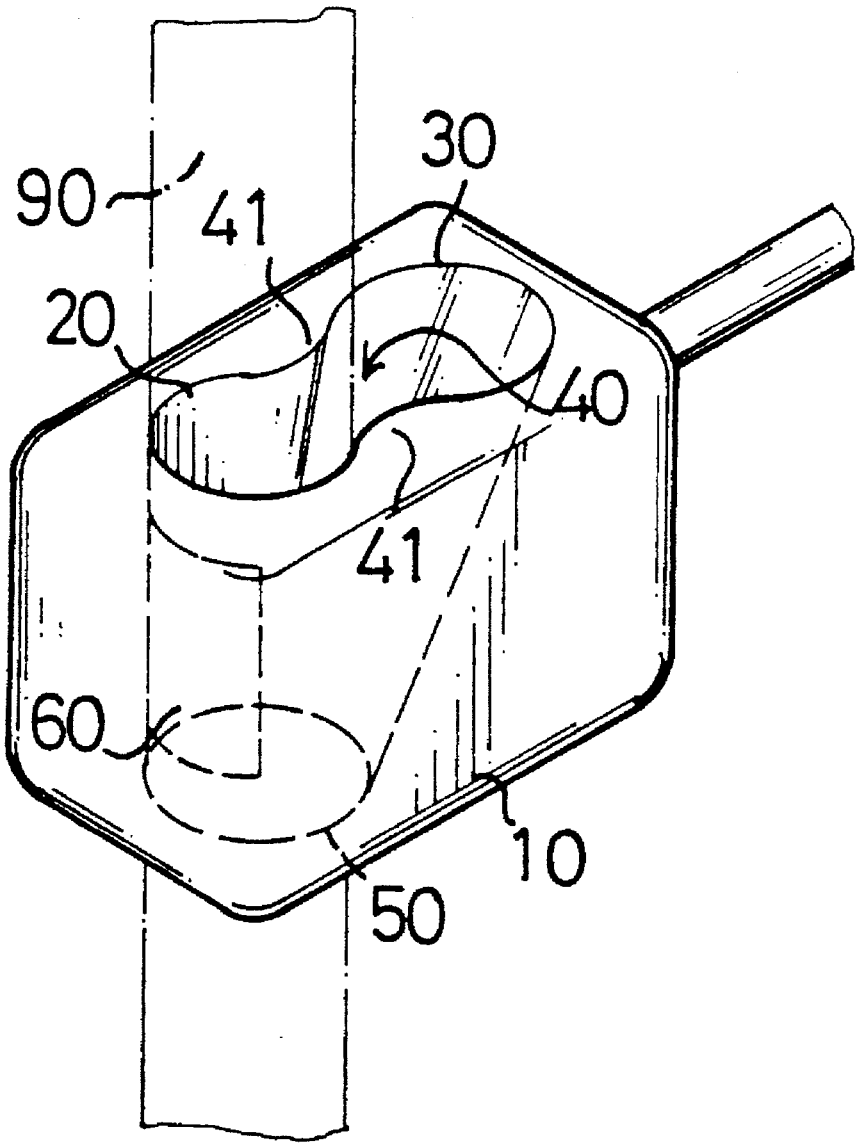
FIG. 1 is a perspective view of a mounting block in accordance with the present invention, the rod to which the block is mounted is shown by phantom lines for clarity.

Referring to the drawings and initially to FIG. 1, a block 10 in accordance with the present invention is adapted to be adjustably mounted to a rod 90 of a clothes rack, flower pot display shelf, black board shelf, or the like. The block 10 includes upper and lower sides. A first through hole 20 extends from the upper side through the lower side and has an upper end (not labeled) and a lower end 50. A second through hole 30 also extends from the upper side through the lower side and has an upper end (not labeled) and a lower end 50. As shown in FIG. 1, the first and second through holes 20 and 30 communicate with each other via a necking passage section 40 formed therebetween, and the lower end 50 of the first through hole 20 coincides with the lower end 50 of the second through hole 30. The first through hole 20 has a central axis which is at an angle to that of the second through hole 30.

The first through hole 20 has a diameter the same as that of the rod 90. The upper end of the second through hole 30 has a diameter greater than that of the rod 90 and tapers to the lower end 50 of the second through hole 30 which coincides with the lower end 50 of the first through hole 20. The necking passage section 40 has two lateral resilient walls 41 which define a passage therebetween to allow the rod 90 to be forcibly moved between the first and second through holes 20 and 30. An antislip piece 60 is provided to an inner periphery of the first through hole 20 for retaining the rod 90 in position. Alternatively, a layer of antislip glue may be applied to the inner periphery of the first through hole 20 for retaining the rod in position.

Figure 2:
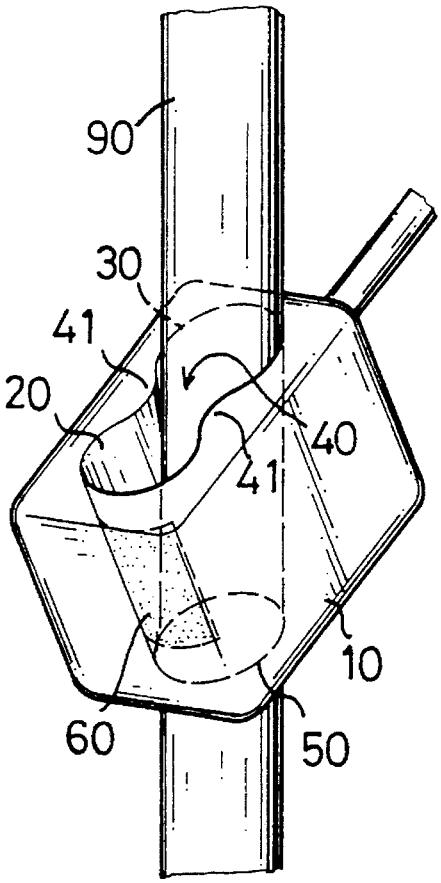
FIG. 2 is a partial perspective view illustrating the block in a status slidable along the rod.

By such an arrangement, when the rod 90 is received in the first through hole 20, the rod 90 is retained in position, and when the rod 90 is received in the second through hole 30 (see FIG. 2), the block 10 is slidable along the rod 90.

Figure 5:
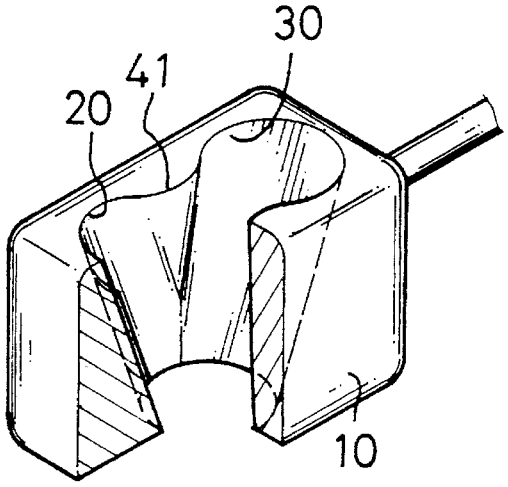
FIG. 5 is a perspective view, partly cut away, of another embodiment of the block in accordance with the present invention.
Figure 6:
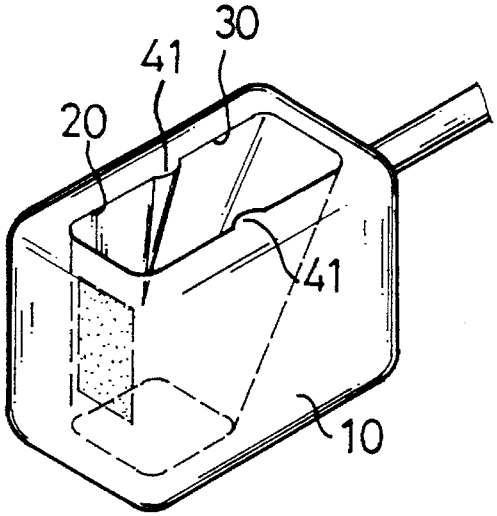
FIG. 6 is a perspective view illustrating a further embodiment of the block in accordance with the present invention.

In this embodiment, the first through hole 20 extends in a vertical direction. Nevertheless, the first and second through holes 20 and 30 may be perpendicular to each other or in an acute angle as shown in FIG. 5. The first and second through holes 20 and 30 may be either circular (see FIG. 1) or rectangular (see FIG. 6) in section depending on a sectional configuration of the rod 90.

Figure 3:
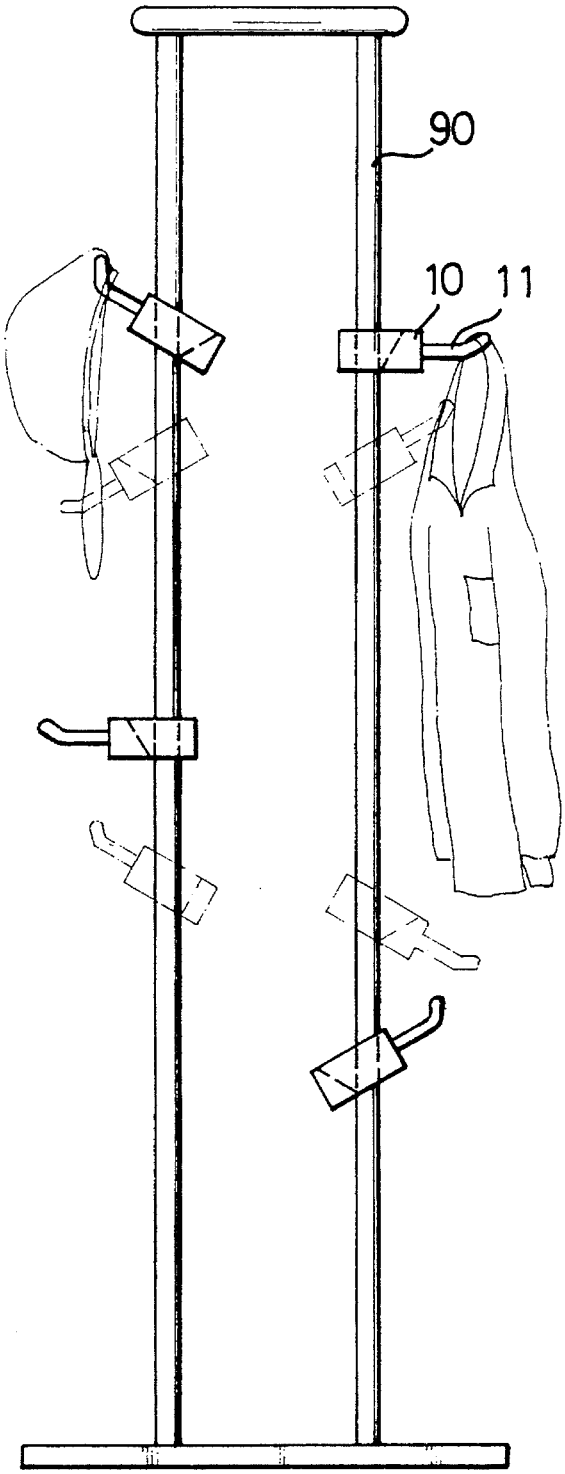
FIG. 3 is a schematic side view illustrating adjustment of the blocks when mounted to a clothes rack.

FIG. 3 illustrates a first application of the blocks 10 in accordance with the present invention in which each block 10 has a hanger 11 attached thereto and is adjustably mounted to an associated vertical rod 90 of a clothes rack in a manner described hereinbefore.

Figure 4:
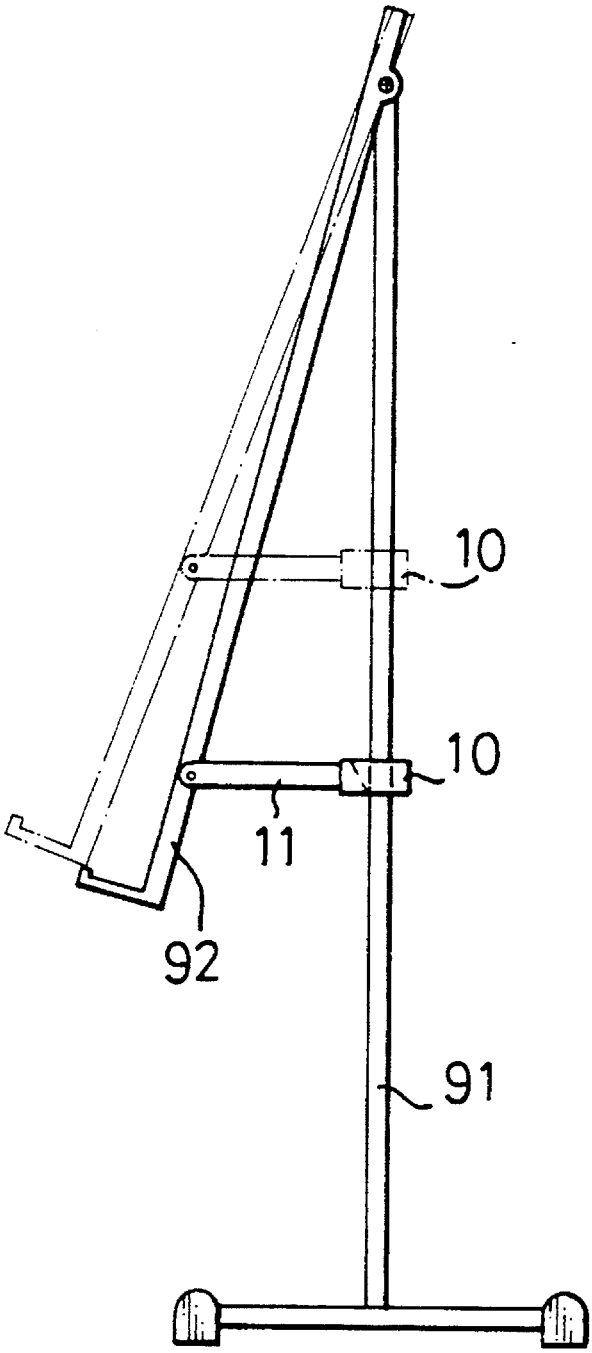
FIG. 4 is a schematic side view illustrating adjustment of the blocks when mounted to a black board shelf.

FIG. 4 illustrates a second application of the blocks 10 in accordance with the present invention in which each block 10 has a beam 11 attached thereto for supporting a black board 92 and is adjustably mounted to an associated vertical rod 91 of a black board shelf.

Although the invention has been explained in relation to its preferred embodiment, it is to be understood that many other possible modifications and variations can be made without departing from the spirit and scope of the invention as hereinafter claimed.

I claim:

1. A block adjustably mounted to a rod, comprising:

a block body having longitudinally spaced upper and lower sides, said block body having a first through hole extending from said upper side through said lower side and having upper and lower ends and an inner periphery extending continuously between said upper and lower ends, a second through hole extending from said upper side through said lower side and having upper and lower ends, a necking passage section defined by a pair of spaced substantially longitudinally directed curved resilient walls formed as a unitary continuation of and disposed between said first and second through holes, and said walls extending substantially from the surface to the bottom surface of said block and providing open communication therebetween, said lower end of said first through hole coincides with said lower end of said second through hole, said first through hole having a central axis which is at an angle with respect to a central axis of said second through hole, said first through hole having a diameter the same as that of said rod, said upper end of said second through hole having a diameter greater than that of said rod and tapering to said lower end of said second through hole which coincides with said lower end of said first through hole, said necking passage section being resilient to allow said rod to be forcibly moved between said first and second through holes; and, antislip means coupled to said inner periphery of said first through hole for resisting displacement of said block body along said rod, whereby when said rod is received in said first through hole, said rod is retained in position, and when said rod is received in said second through hole, said block is slidable along said rod.

2. The block as claimed in claim 1 wherein said central axis of said first through hole extends in a vertical direction.

3. The block as claimed in claim 1 wherein said antislip means is an antislip piece mounted to said inner periphery of said first through hole for retaining said rod in position.

4. The block as claimed in claim 1 wherein said antislip means is a layer of antislip glue applied to said inner periphery of said first through hole for retaining said rod in position.

5. The block as claimed in claim 1 wherein said first and second through holes are circular in section.

6. The block as claimed in claim 1 wherein said first and second through holes are rectangular in section.

* * * * *